US010377129B2

(12) United States Patent
Ishikawa

(10) Patent No.: US 10,377,129 B2
(45) Date of Patent: Aug. 13, 2019

(54) PRINTING APPARATUS

(71) Applicant: SEIKO EPSON CORPORATION, Tokyo (JP)

(72) Inventor: Yugo Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/881,236

(22) Filed: Jan. 26, 2018

(65) Prior Publication Data

US 2018/0215142 A1 Aug. 2, 2018

(30) Foreign Application Priority Data

Feb. 1, 2017 (JP) ..... 2017-016532

(51) Int. Cl.

| | |
|---|---|
| ***B41J 3/28*** | (2006.01) |
| ***B41J 11/00*** | (2006.01) |
| ***B41J 2/045*** | (2006.01) |
| *B41J 2/14* | (2006.01) |

(52) U.S. Cl.

CPC ..... *B41J 2/04503* (2013.01); *B41J 2/04581* (2013.01); *B41J 11/0095* (2013.01); *B41J 2002/14193* (2013.01)

(58) Field of Classification Search

CPC ..... B41J 3/28; B41J 11/0095; B41J 11/007; B41J 2/04503; B41J 2/04581

See application file for complete search history.

(56) References Cited

U.S. PATENT DOCUMENTS

2007/0009275 A1* 1/2007 Yokoyama ..... B41J 3/28 399/69
2010/0220130 A1* 9/2010 Bruno ..... B41J 2/16517 347/9

FOREIGN PATENT DOCUMENTS

JP 2015-217604 A 12/2015

* cited by examiner

*Primary Examiner* — Jason S Uhlenhake
(74) *Attorney, Agent, or Firm* — Workman Nydegger

(57) ABSTRACT

A printing apparatus includes an ejecting head that ejects ink droplets onto a surface of a printing medium (paper roll), a carriage on which the ejecting head is mounted, a platen that faces the ejecting head and supports the printing medium, a detector plate provided in the carriage and is displaced in accordance with an external force applied in response to contact with the printing medium, and an encoder that measures a displacement amount of the detector plate and outputs an output value corresponding to the displacement amount.

5 Claims, 9 Drawing Sheets

PRINTING APPARATUS

BACKGROUND

1. Technical Field

The present invention relates to a printing apparatus that performs printing by ejecting droplets.

2. Related Art

A printer of the related art that uses a method in which ink droplets are ejected onto the surface of a printing medium while an ink jet head is reciprocated to form (print) an image is well known. Some of such printers include a function that detects a state of contact with the printing medium by using a sensor such as a photo interrupter in order to prevent an ink jet head from being in contact with the printing medium and scratching printed material at the time of reciprocation and to prevent the nozzle surface of the ink jet head from being damaged (for example, JP-A-2015-217604).

Here, rigidity differs depending on the type of the printing medium, and therefore, the magnitude of the contact force (that is, the degree of influence of the printing medium on the ink jet head) differs depending on the type of the printing medium when the printing medium is in contact with the ink jet head. For example, the degree of influence of the printing medium on the ink jet head differs greatly in a contact force between a high-rigidity printing medium, such as a thick resin film, and a low-rigidity printing medium, such as a thin fabric.

In the above-described detection method (method described in JP-A-2015-217604), the magnitude of the contact force cannot be detected, and therefore, although it is unnecessary that a printing operation be stopped for substantially non-problematic contact (for example, contact resulting in, for example, blurring on a low-rigidity printing medium), the operation is stopped each time the contact is detected, thereby causing a problem in which unnecessary downtime occurs. In addition, in a case in which sensitivity detected by a sensor is set low in order to reduce such downtime, even when a highly rigid printing medium jams with the ink jet head, printing is likely to be continued, and therefore, there is a risk in which the ink jet head is damaged.

SUMMARY

An advantage of some aspects of the invention can be realized as the following aspects or embodiments.

Application Example 1

A printing apparatus according to an aspect of the invention includes an ejecting head that ejects droplets onto a surface of a printing medium, a carriage on which the ejecting head is mounted, a printing medium supporting section that faces the ejecting head and supports the printing medium, a displacement section that is provided in the carriage and is displaced in accordance with an external force applied in response to contact with the printing medium, and an encoder that measures a displacement amount of the displacement section and outputs an output value corresponding to the displacement amount.

In Application Example 1, the printing apparatus includes the displacement section displaced depending on the external force applied by the contact with the printing medium and the encoder that measures the displacement amount of the displacement section and outputs the output value corresponding to the displacement amount, and the degree of contact between the displacement section mounted on the carriage and the printing medium can be detected.

Application Example 2

The printing apparatus further includes a movement section that moves the carriage and the printing medium supporting section relative to each other, and a control section that controls the movement section. The control section controls the movement section in accordance with the output value.

In Application Example 2, movement of at least one of the carriage and the printing medium supporting section can be controlled in accordance with the output value from the encoder (that is, the external force applied to the displacement section by the contact with the printing medium). As a result, a printing sequence can be switched appropriately, for example, depending on a state of contact such as rubbing, jamming, or contact with foreign matter, and unnecessary downtime can be prevented from occurring.

Application Example 3

In the printing apparatus, the control section controls the movement section in accordance with a number of times in each of which the output value exceeds a specific threshold value.

In Application Example 3, the relative movement operation between the carriage and the printing medium supporting section can be controlled in accordance with the number of times in each of which the output value from the encoder exceeds the specific threshold value. Therefore, the carriage can be controlled so as to be temporarily stopped or the like, for example, in accordance with frequency of contact even when the contact is light in addition to strength of contact. As a result, the printing apparatus instructs a user (operator) of the printing apparatus to perform required maintenance, and removes a mild impact on printed material and prevent occurrence of a severe impact.

Application Example 4

In the printing apparatus, the control section controls the movement section based on a type of the printing medium.

When rigidity differs depending on the type of the printing medium, the degree of influence of the contact with the printing medium varies depending on the type of the printing medium.

In Application Example 4, the control section controls the movement section in accordance with the type of the printing medium and the output value corresponding to the displacement amount of the displacement section displaced in accordance with the external force applied by the contact with the printing medium. Therefore, a printing sequence can be further appropriately controlled in accordance with the degree of the influence of the contact with the printing medium.

Application Example 5

In the printing apparatus, the displacement section is provided close to the printing medium supporting section, compared with the ejecting head.

In Application Example 5, the displacement section is provided closer to the printing medium supporting section, compared with the ejecting head, such that, before the printing medium is in contact with the ejecting head, the contact can be detected. As a result, the ejecting head can be prevented from being damaged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
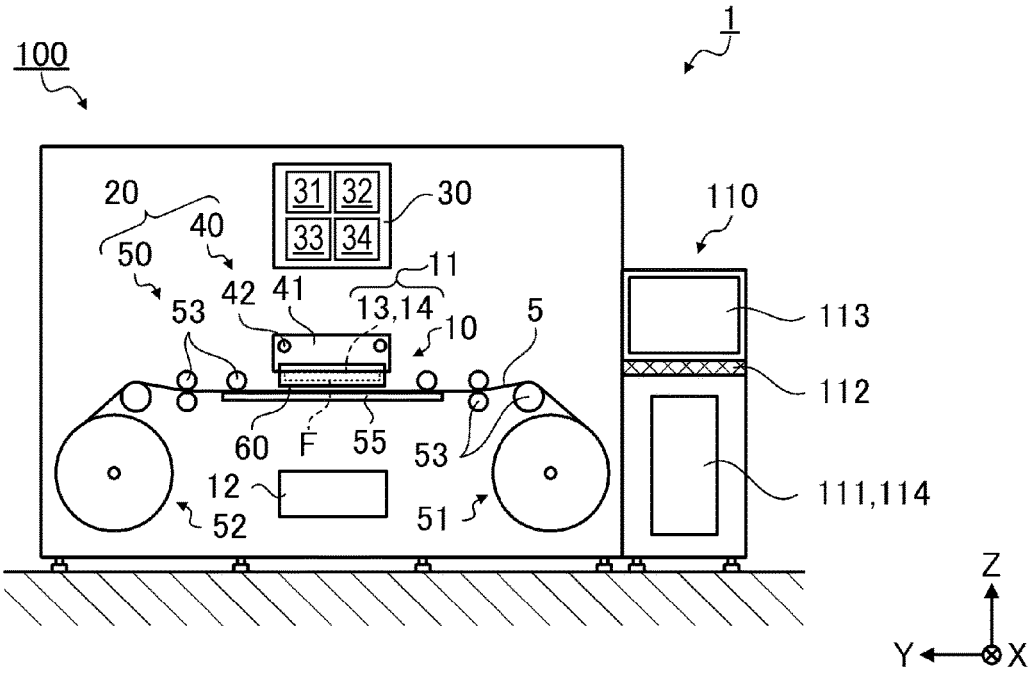
FIG. 1 is a front view illustrating a configuration of a printer as a printing apparatus according to a first embodiment.

Embodiments of the invention are described below with reference to drawings. The embodiments described below are examples of the invention and do not limit the invention. Here, in order to make the explanation easier to understand, the following drawings may be illustrated by using scales different from the actual scales. In addition, in the coordinates illustrated in the drawings, the Z-axis direction denotes the vertical direction, the +Z direction denotes the upward direction, the X-axis direction denotes the front/rear direction, the −X direction denotes the forward direction, the Y-axis direction denotes the left/right direction, the +Y direction denotes the leftward direction, and the X-Y plane denotes the horizontal plane.

First Embodiment

Figure 2:
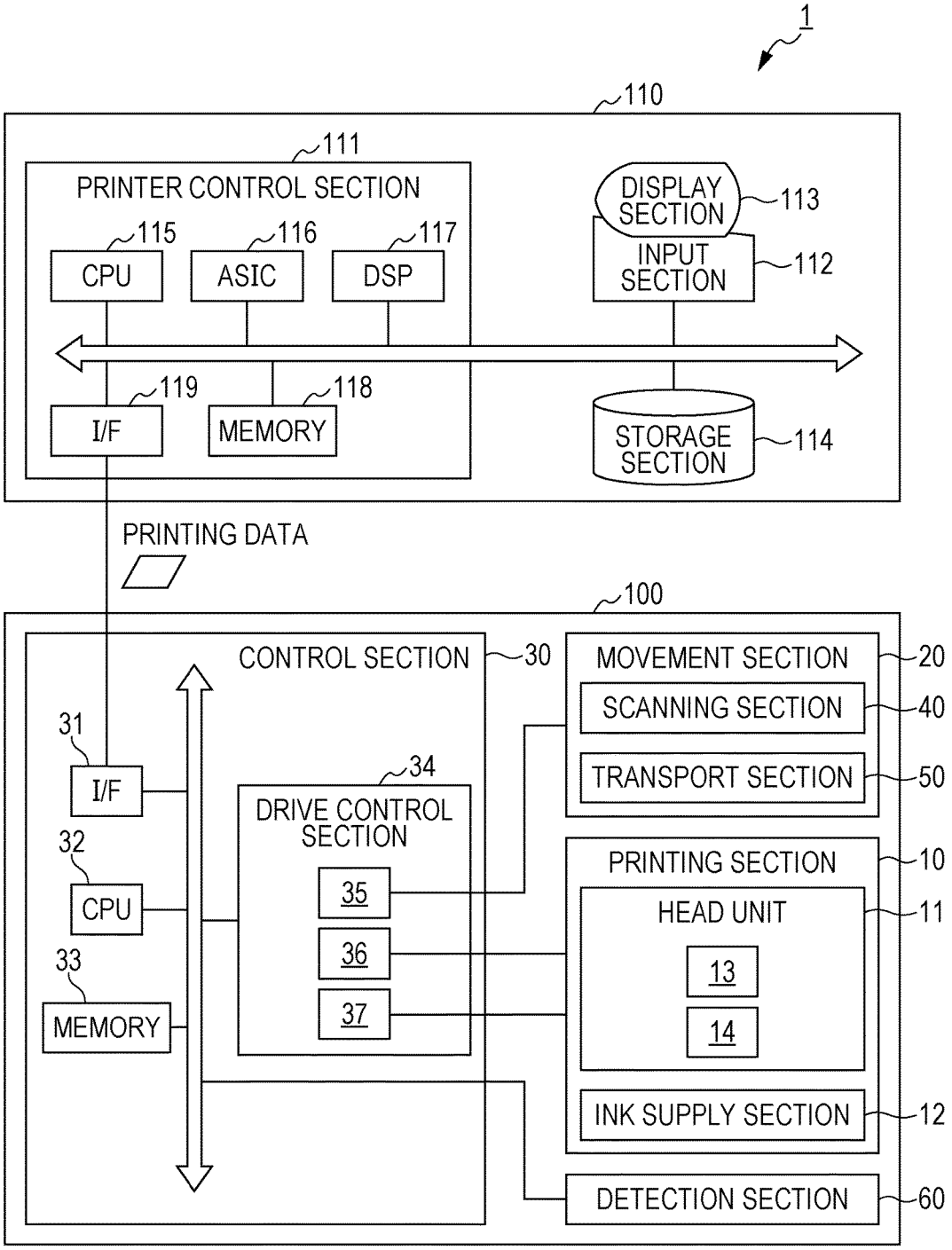
FIG. 2 is a block diagram illustrating the configuration of the printer as the printing apparatus according to the first embodiment.

FIG. 1 is a front view illustrating a configuration of a printer 100 as a "printing apparatus" according to a first embodiment, and FIG. 2 is a block diagram illustrating the configuration of the printer 100 according to the first embodiment.

The printer 100 and an image processing apparatus 110 connected to the printer 100 constitute a printing system 1. The printer 100 is an ink jet printer that prints a desired image onto a paper roll 5 as an elongated "printing medium" supplied in a rolled state, in accordance with printing data including pixel data received from the image processing apparatus 110.

Basic Configuration of the Image Processing Apparatus

The image processing apparatus 110 includes a printer control section 111, an input section 112, a display section 113, and a storage section 114 and controls a printing job that causes the printer 100 to perform printing. Preferably, the image processing apparatus 110 is implemented as a personal computer.

Software with which the image processing apparatus 110 is operated includes typical image processing application software that handles printing image data (hereinafter referred to as an application) and printer driver software that controls the printer 100 and generates printing data with which the printer 100 is caused to perform printing (hereinafter referred to as a printer driver).

The printer control section 111 includes a central processing unit (CPU) 115, an application specific integrated circuit (ASIC) 116, a digital signal processor (DSP) 117, a memory 118, and a printer interface section 119, and performs centralized management of the whole printing system 1.

The input section 112 is an information input mechanism implemented as a human interface device. Specifically, the input section 112 is a port to which a keyboard and an information input device are connected.

The display section 113 is an information display mechanism (display) implemented as a human interface device, and, under the control of the printer control section 111, displays information input via the input section 112, an image to be printed by the printer 100, information on a printing job, and the like.

The storage section 114 is a rewritable storage medium such as a hard disk drive (HDD) or a memory card and stores the software with which the image processing apparatus 110 is operated (program operated in the printer control section 111), an image to be printed, the information on a printing job, and the like.

The memory 118 is a storage medium in which an area that stores a program processed by the CPU 115, a work area used by the CPU 115 during operation, and the like, are ensured and is implemented as a memory element such as a random access memory (RAM) or an electrically erasable programmable read-only memory (EEPROM).

Basic Configuration of the Printer 100

The printer 100 is constituted by a printing section 10, a movement section 20, a control section 30, a detection section 60, and the like. The printer 100 that has received printing data from the image processing apparatus 110 controls the printing section 10 and the movement section 20 by using the control section 30 and prints (forms) an image onto the paper roll 5.

The printing data is, for example, image formation data obtained by executing conversion processing on typical image data of an image captured by a digital camera or the like (for example, RGB digital image information) such that the data can be printed by the printer 100 by using the application and the printer driver included in the image processing apparatus 110, and the printing data includes a command used to control the printer 100.

The printing section 10 is constituted by a head unit 11, an ink supply section 12, and the like.

The movement section 20 is constituted by a scanning section 40, a transport section 50, and the like. The scanning section 40 is constituted by a carriage 41, a guide shaft 42, a carriage motor (not illustrated), and the like. The transport section 50 is constituted by a supply section 51, an accommodation section 52, a transport roller 53, a platen 55 as a "printing medium supporting section", and the like.

The head unit 11 includes an ejecting head 13 including two or more nozzles (nozzle row), each of which ejects liquid (printing ink, hereinafter, referred to as ink) as droplets (hereinafter referred to as ink droplets) and a head control section 14. The head unit 11 is mounted on the carriage 41 and is reciprocated in a scanning direction (X-axis direction illustrated in FIG. 1) in accordance with the movement of the carriage 41 in the scanning direction.

The platen 55 is provided so as to support the paper roll 5 and to face the ejecting head 13 moved so as to be supported by the carriage 41.

Under the control of the control section 30, the head unit 11 (ejecting head 13) ejects ink droplets onto the paper roll 5 supported by the platen 55 while moving in the scanning direction, such that a dot row (raster line) arranged in the scanning direction is formed onto the paper roll 5.

The ink supply section 12 includes an ink tank (not illustrated) and an ink supply path (not illustrated) that supplies ink to the ejecting head 13 from the ink tank.

As ink set that constitutes a dark ink composition, for example, an ink set of four colors such as cyan (C), magenta (M), yellow (Y), and black (K), is provided. In addition, for example, an ink set of eight colors obtained by adding, to the above-described four colors, light cyan (Lc), light magenta (Lm), light yellow (Ly), and light black (Lk) constitute a light ink composition and is obtained by reducing concentrations of the respective coloring materials. The ink tank, the ink supply path, and an ink supply channel up to a nozzle that ejects a common ink, are provided for each ink.

As a method in which ink droplets are ejected (ink jet method), a piezo method is used. A piezo method is a method in which pressure based on a printing information signal is applied to ink stored in a pressure chamber by an actuator using a piezoelectric element, and ink droplets are ejected through a nozzle in communication with the pressure chamber to perform printing.

Here, a method in which ink droplets are ejected is not limited to such an example and may be another printing method in which ink droplets are ejected to form a dot group on a printing medium.

Under the control of the control section 30, the movement section 20 (the scanning section 40 and the transport section 50) moves the paper roll 5 relative to the printing section 10.

The guide shaft 42 extends in the scanning direction and supports the carriage 41 such that the carriage 41 can be slid, and the carriage motor is a driving source when the carriage 41 is reciprocated along the guide shaft 42. That is, under the control of the control section 30, the scanning section 40 (the carriage 41, the guide shaft 42, and the carriage motor) moves the carriage 41 (that is, the ejecting head 13) along the guide shaft 42 in the scanning direction.

The supply section 51 supports a reel around which the paper roll is wound such that the reel can be rotated, and transports the paper roll 5 to a transport path. The accommodation section 52 supports the reel that is to roll up the paper roll 5 such that the reel can be rotated, and rolls up, the paper roll 5 on which the printing has been completed, from the transport path.

The transport roller 53 includes a drive roller that moves the paper roll 5 in the transport direction that crosses the scanning direction (Y-axis direction illustrated in FIG. 1), a following roller rotated in accordance with the movement of the paper roll 5, and the like and is include in a transport path through which the paper roll 5 is transported to the accommodation section 52 from the supply section 51 via a printing area of the printing section 10 (area in which the ejecting head 13 moves in the scanning direction on the upper surface of the platen 55).

The control section 30 includes an interface section 31, a CPU 32, a memory 33, and a drive control section 34 and controls the printer 100.

The interface section 31 is connected to the printer interface section 119 of the image processing apparatus 110, and data is transmitted and received between the image processing apparatus 110 and the printer 100 through the interface section 31.

The CPU 32 is an arithmetic processing unit used to control the whole printer 100.

The memory 33 is a storage medium in which an area that stores a program processed by the CPU 32, a work area used by the CPU 32 during operation, and the like, are ensured and is implemented as a memory element such as a RAM, an EEPROM, or the like.

The CPU 32 controls the printing section 10 and the movement section 20 through the drive control section 34 in accordance with a program loaded into the memory 33 and printing data that has been received from the image processing apparatus 110.

The drive control section 34 controls driving of the printing section 10 (the head unit 11 (the head control section 14) and the ink supply section 12) and the movement section 20 (the scanning section 40 and the transport section 50) in accordance with the control of the CPU 32. The drive control section 34 includes a movement control signal generation circuit 35, an ejecting control signal generation circuit 36, and a drive signal generation circuit 37 as a "drive waveform generation unit".

The movement control signal generation circuit 35 is a circuit that generates a signal used to control the movement section 20 (the scanning section 40 and the transport section 50) in accordance with an instruction from the CPU 32.

The ejecting control signal generation circuit 36 is a circuit that generates a head control signal used to select a nozzle that is to eject ink, select an amount of the ink to be ejected, control a timing at which the ink is ejected, and the like in response to an instruction from the CPU 32 and in accordance with the printing data.

The drive signal generation circuit 37 is a circuit that generates a drive signal used to drive an actuator that causes ink droplets to be ejected.

In the above-described configuration, the control section 30 forms (prints) a desired image onto the paper roll 5 by repeating a path operation in which ink droplets are ejected from the ejecting head 13 onto the paper roll 5 that has been supplied to the printing area by the transport section 50 (the supply section 51 and the transport roller 53) while the carriage 41 that supports the ejecting head 13 along the guide shaft 42 is moved by the transport section 50 (transport roller 53) in the scanning direction (X-axis direction) and a transport operation in which the paper roll 5 is moved in the transport direction (+Y direction) that crosses the scanning direction.

The detection sections 60 are detection mechanisms each of which detects a risk of contact between the paper roll 5 and the ejecting head 13 and the degree of contact in the printing area and are provided at respective ends of the carriage 41 in the scanning direction (X-axis direction).

A detection result (output value) of the detection section 60 is transmitted to the control section 30, and the control section 30 controls the movement section 20 (the scanning section 40 and the transport section 50) in accordance with the transmitted output value.

A specific configuration of the detection section 60 and control of the movement section 20 (the scanning section 40 and the transport section 50) in accordance with the output value of the detection section 60 by the control section 30 are described later.

Basic Function of the Printer Driver

Figure 3:
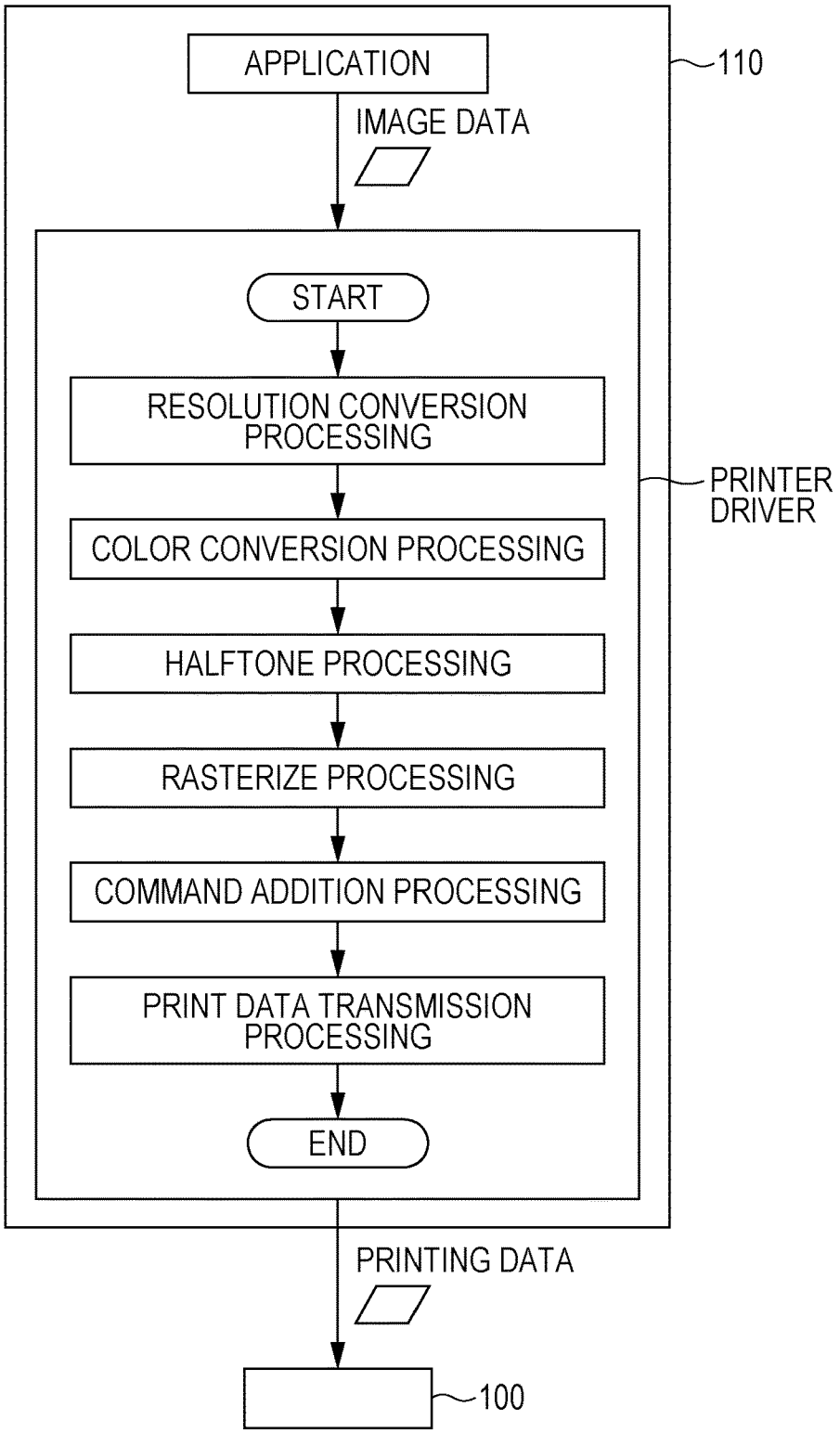
FIG. 3 is a diagram illustrating a basic function of a printer driver.

FIG. 3 is a diagram illustrating a basic function of the printer driver.

Printing onto the paper roll 5 starts when printing data is transmitted from the image processing apparatus 110 to the printer 100. The printing data is generated by the printer driver.

Generation of printing data is described below with reference to FIG. 3.

The printer driver receives image data (for example, text data, full-color image data, or the like) from an application, converts the image data into printing data in a format that can be interpreted by the printer 100, and outputs the printing data to the printer 100. When the image data from the application is converted into the printing data, the printer driver executes resolution conversion processing, color conversion processing, halftone processing, rasterize processing, command addition processing, and the like.

The resolution conversion processing is processing in which image data that has been output from the application is converted into data having a resolution (printing resolution) when image data is to be printed onto the paper roll 5. For example, when the printing resolution is specified as 720×720 dpi, image data having a vector format, which has been received from the application, is converted into image data of a bitmap format at a resolution of 720×720 dpi. Data of each pixel of the image data that has been subjected to the resolution conversion processing denotes pixels arrayed in a matrix. Each of the pixels has, for example, a respective tone value of 256 gradations of a RGB color space. That is, the pixel data that has been subjected to the resolution conversion processing denotes corresponding tone values of pixels.

Pixel data corresponding to a one-column portion of pixels arrayed in a specific direction from among pixels arrayed in the matrix is referred to as raster data. Here, the specific direction in which pixels corresponding to the raster data are arrayed is the movement direction (scanning direction) of the ejecting head 13 when an image is printed.

The color conversion processing is processing in which RGB data is converted into data of a CMYK color space. CMYK color consists of cyan (C), magenta (M), yellow (Y), and black (K) components, and image data of the CMYK color space is data corresponding to colors of ink included in the printer 100. Thus, for example, when the printer 100 uses 10 types of ink of the CMYK color space, the printer driver generates, in accordance with the RGB data, image data of a 10-dimensional space of the CMYK color space.

The color conversion processing is executed in accordance with a table (a color conversion look-up table LUT) in which tone values of RGB data are associated with respective tone values of CMYK color space data. Here, pixel data that has been subjected to the color conversion processing is, for example, CMYK color space data of 256 gradations represented by the CMYK color space.

The halftone processing is processing in which data having a high tone number (256 gradations) is converted into data having a gradation number that can be created by the printer 100. In the halftone processing, data indicating 256 gradations is converted, for example, into one-bit data indicating two gradations (a dot or non-dot) or two-bit data indicating four gradations (non-dot, a small dot, a medium dot, and a large dot). Specifically, dot generation rates corresponding to tone values (for example, generation rates of the non-dot, the small dot, the medium dot, and the large dot in the case of the four gradations) are obtained from a dot generation rate table in which tone values (0 to 255) are associated with respective dot generation rates, and in the obtained generation rates, pixel data is created such that dots are formed separately by using a dither method/error diffusion method or the like.

The rasterize processing is processing in which pieces of pixel data of pixels arrayed in a matrix (for example, one-bit data or two-bit data as described above) are rearranged in dot formation order at the time of printing. The rasterize processing includes path allocation processing in which image data constituted by pieces of pixel data that have been subjected to the halftone processing is allocated to each path through which ink droplets are ejected while the ejecting head 13 (nozzle row) is moved in the scanning direction. When the path allocation has been completed, allocation of the actual nozzle used to form raster lines that constitute a printing image is performed.

The command addition processing is processing in which command data corresponding to a printing method is added to data that has been subjected to the rasterize processing. The command data includes, for example, transport data related to a transport specification of a medium (speed, movement amount in the transport direction, and the like).

Under the control of the CPU 115, such pieces of processing by the printer driver are executed by the ASIC 116 and the DSP 117 (see FIG. 2), and the generated printing data is transmitted to the printer 100 through the printer interface section 119.

Nozzle Row

Figure 4:
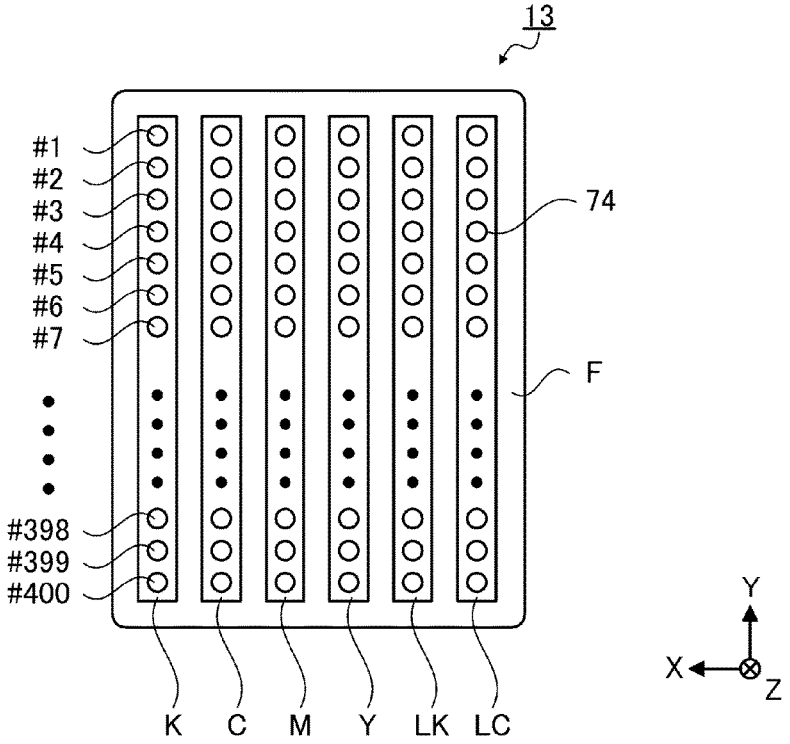
FIG. 4 is a schematic diagram illustrating an example of array of nozzles viewed from the bottom surface of an ejecting head.

FIG. 4 is a schematic diagram illustrating an example of an array of nozzles viewed from the bottom surface (nozzle formation surface F (see FIG. 1)) of the ejecting head 13.

As illustrated in FIG. 4, the ejecting head 13 includes nozzle rows each of which is formed such that two or more nozzles 74 are arrayed and eject ink of a respective color (a black ink nozzle row K, a cyan ink nozzle row C, a magenta ink nozzle row M, a yellow ink nozzle row Y, a gray ink nozzle row Lk, and a light cyan ink nozzle row Lc each of which consists of 400 nozzles from #1 to #400 in the example of FIG. 4).

The two or more nozzles 74 of each of the nozzle rows are arrayed at specific intervals (nozzle pitches) in the transport direction (Y-axis direction). In FIG. 4, a smaller number from among #1 to #400 is assigned to the nozzle 74 of each of the nozzle rows downstream in the transport direction. That is, the nozzle 74 #1 is positioned downstream in the transport direction, compared with the nozzle 74 #400. In each nozzle 74, a corresponding drive element (the above-described piezoelectric element) used to drive the nozzle 74 and cause ink droplets to be ejected is provided.

Detection Section

Figure 5:
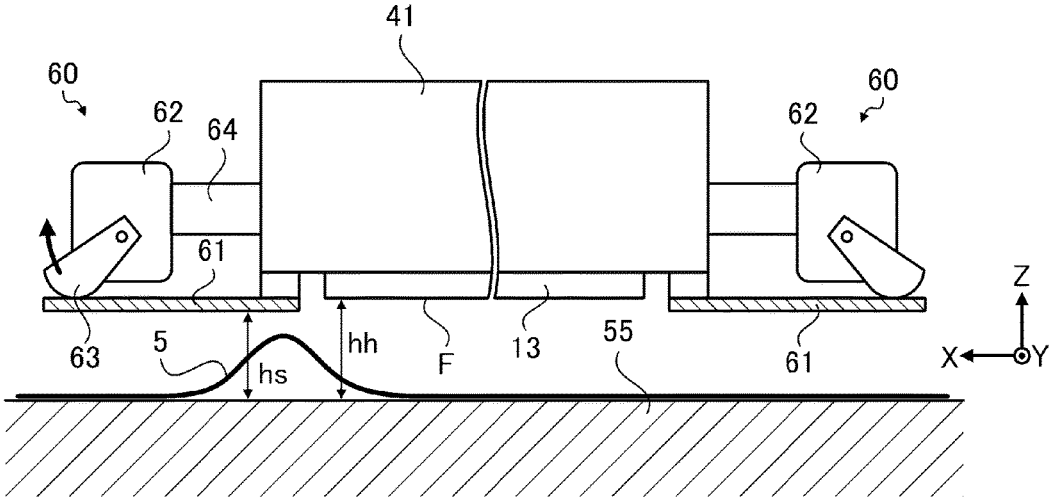
FIG. 5 is a side view illustrating a configuration of a detection section.
Figure 6:
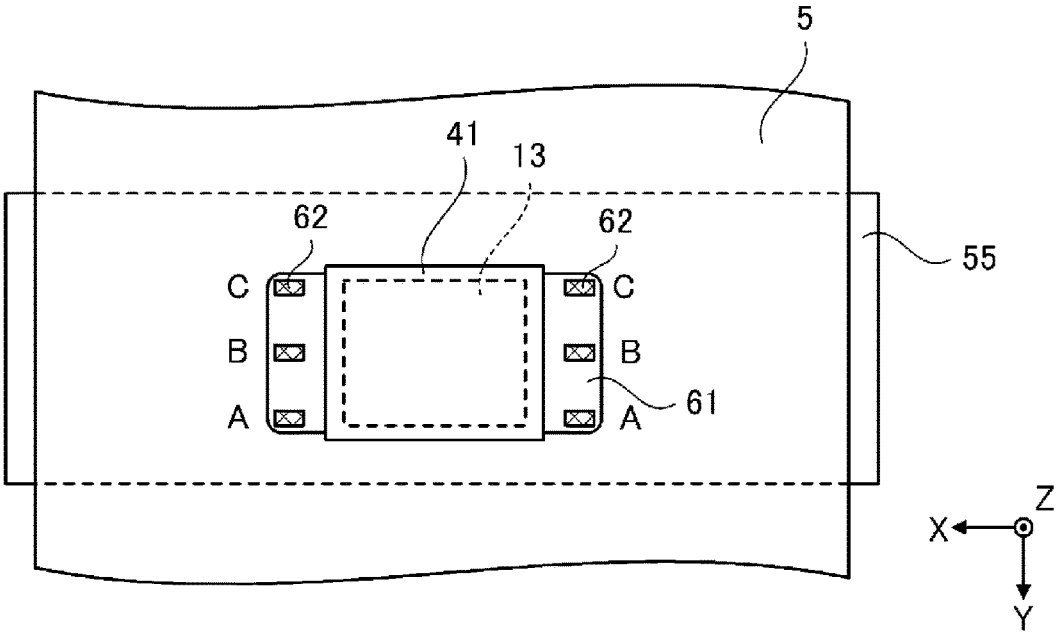
FIG. 6 is a plan view illustrating the configuration of the detection section.

FIG. 5 is a side view illustrating a configuration of the detection section 60, and FIG. 6 is a plan view illustrating the configuration of the detection section 60.

The detection section 60 includes a detector plate 61 and an encoder 62 as a "displacement section".

The detector plates 61 are a pair of flat plates provided below respective ends of the carriage 41 in the scanning direction (X-axis direction) so as to be almost parallel to the platen 55, and one end of the detector plate 61 in the scanning direction (X-axis direction) is respectively fixed to an area of the lower end surface of each side of the carriage 41 in the scanning direction (X-axis direction), and the other end of the detector plates 61 is respectively provided so as to become a free end on the side opposite to the carriage 41.

In addition, the detector plate 61 is provided such that a height hs from the surface of the platen 55 (supporting surface of the paper roll 5) to the bottom surface of the detector plate 61 becomes smaller than a height hh from the surface of the platen 55 to the bottom surface of the ejecting head 13 (nozzle formation surface F). That is, the detector plate 61 is provided closer to the platen 55 compared with the ejecting head 13.

The detector plate 61 has an elastic material, and a resin plate is used as a preferred example of the detector plate 61, but the detector plate 61 is not limited to such an example. For example, the detector plate 61 may be a metal plate.

In such a configuration, the free end area of the detector plate 61 (the other end area on the side opposite to the carriage 41) is displaced in accordance with an external force. Thus, for example, the free end area is displaced in accordance with an external force that has been applied in response to contact with the paper roll 5 that has been supplied to the printing area.

The encoders 62 are rotary encoders each of which detects a displacement amount of the free end area of the detector plate 61 (the other end area on the side opposite to the carriage 41), are supported by respective supporting sections 64 at respective ends of the carriage 41 in the scanning direction (X-axis direction), and are provided above the respective detector plates 61. The encoder 62 includes a rotating piece 63 that is in contact with the upper surface of the free end area of the detector plate 61 and converts rotational displacement of a rotation shaft of the rotating piece 63, which is caused by the displacement of the free end area of the detector plate 61, into a digital signal and outputs the digital signal. That is, the encoder 62 measures the displacement amount of the detector plate 61 and outputs an output value corresponding to the displacement amount.

Here, the rotating piece 63 rotates so as to follow the detector plate 61 displaced in accordance with an external force applied in response to contact with the paper roll 5 and is returned to the original position (that is, the position in which the detector plate 61 becomes almost parallel to the platen 55) with respect to the detector plate 61 when the external force in response to contact with the paper roll 5 is no longer applied.

In addition, the encoder 62 is not limited to the rotary encoder and may be an encoder that can detect a displacement amount of the free end area of the detector plate 61. For example, the encoder 62 may be a linear encoder or another type of sensor (for example, a potentiometer, a capacitive transducer, an electromagnetic induction-type transducer, or the like).

As illustrated in FIG. 6, it is preferable that encoders 62 are provided in the +Y direction at respective end areas A of the upper surfaces of the free end areas of the detector plates 61, provided in the Y-axis direction on respective center areas B of the detector plates 61, and provided in the −y direction at respective end areas C of the detector plates 61, but may be provided, for example, only on the respective center areas B when there is little bias in in-plane displacement of the detector plate 61 in response to an external force due to the rigidity or the size and shape of the detector plate 61.

Here, it is preferable that the rigidity (rigidity ratio, Young's modulus, or the like) and the dimension (length, depth, or the like) of a material of the detector plate 61 are determined after sufficient evaluation has been made in advance by comprehensively considering the magnitude of a detected external force (that is, rigidity of the paper roll 5 that is a target and the degree of contact with the paper roll 5), the detection sensitivity of the encoder 62, and the like.

Control in Printing Sequences

Control of the movement section 20 (the scanning section 40 and the transport section 50) by the control section 30 in accordance with the output value of the detection section 60 is described below.

The control section 30 can detect contact between the paper roll 5 and the carriage 41 (ejecting head 13) with high accuracy (accuracy for a small displacement) by detecting a small displacement of the detector plate 61. In addition, the control section 30 can control various printing sequences corresponding to state of contacts between the paper roll 5 and the carriage 41 (the ejecting head 13) by applying various threshold values that have been prepared in advance to an output value based on a displacement amount of the detector plate 61, which is obtained from the detection section 60.

For example, when the evaluation has been performed in advance, levels of contacts such as no-contact, a light friction degree contact, contact in which mechanical damage (damage to the carriage 41 and the ejecting head 13) is not concerned but an impact on the printing quality is concerned, and contact in which mechanical damage is concerned can be classified for the output value of the detection section 60. That is, the evaluation is performed in advance for each type of a printing medium, and threshold values each used to identify a state of contact are prepared as a control table for each printing medium, and therefore, a printing sequence can be further appropriately controlled in accordance with the type of the printing medium.

In the embodiment, values of D1, D2, D3, and N1, which are described below and are control threshold values for the output value Dx of the detection section 60 are stored in the memory 33 (see FIG. 2) as a control table in which a printing sequence for each printing medium is controlled.

Here, "D1" is a threshold value of a level in which "no-contact" is determined when "$0 \leq Dx < D1$" is satisfied. In addition, "D1" is, for example, a value having a noise level detected as vibrations or the like caused by the operation of the printer 100, and is a threshold value to distinguish the noise level from an output value obtained by the actual contact.

In addition, "D2" is a threshold value of a level in which "light friction degree contact" is determined when "$D1 \leq Dx < D2$" is satisfied.

In addition, "D3" is a threshold value of a level in which "contact in which mechanical damage (damage to the carriage 41 and the ejecting head 13) is not concerned, but an impact on the printing quality is concerned" is determined when "$D2 \leq Dx < D3$" is satisfied, and "contact in which mechanical damage is concerned" is determined when "$D3 \leq Dx$" is satisfied. The output value of "$D3 \leq Dx$" corresponds to a level detected even by contact with foreign matter other than the printing medium (paper roll 5).

In addition, "N1" is a threshold value for the number of times in each of which contact occurs, for which it is determined that measures are needed to be taken when even a light friction degree contact ($D1 \leq Dx < D2$) occurs a plurality of times. In other words, "N1" is threshold value in order to determine that any handling will be need even in a case in which a light friction degree contact ($D1 \leq Dx < D2$) occurs a plurality of times.

Figure 7:
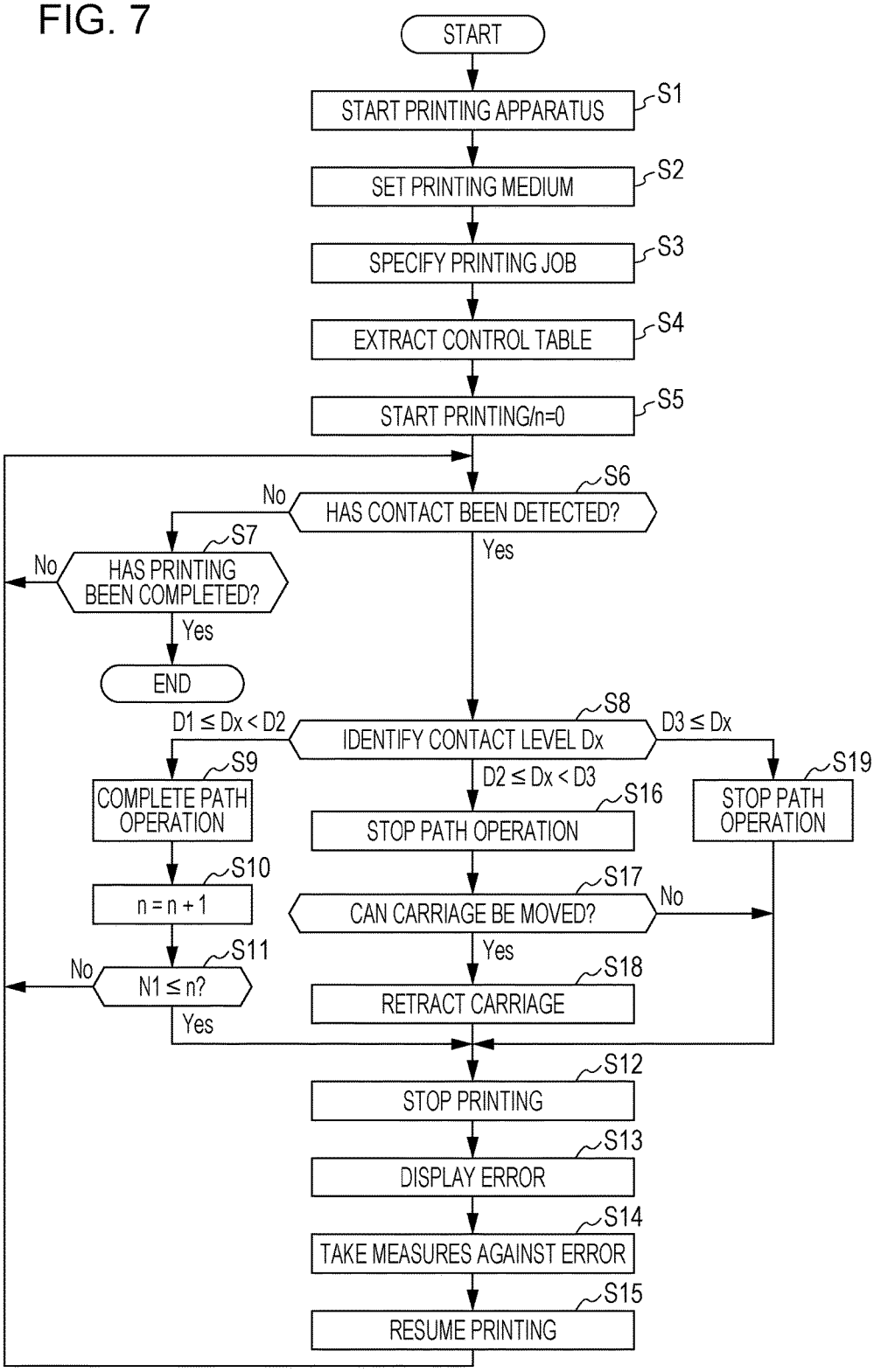
FIG. 7 is a flowchart illustrating an example of a series of printing sequences.

FIG. 7 is a flowchart illustrating an example of a series of printing sequences including a work of the operator of the printer 100.

The flowchart includes an example of a control sequence of the control section 30 when contact with the paper roll 5 has been detected.

First, the printer 100 (printing apparatus) starts (Step S1).

Next, the paper roll 5 (printing medium) is set to the printer 100 (Step S2).

Next, a printing job is specified by the image processing apparatus 110 (Step S3). The printing job is a data package of information necessary for causing the printer 100 to execute a printing operation, and includes information used to specify printing image data, a printing quality (clarity, high-definition, and the like), a printing amount (the number of prints, or the like), a type of a printing medium (attribute information onto the paper roll 5), and the like.

Next, when the printing job is specified, the image processing apparatus 110 generates printing data and transmits the generated printing data to the printer 100, and the control section 30 that has received the printing data extracts a control table used to perform control in accordance with the printing job (printing data), from the memory 33 (Step S4) to start the printing (Step S5).

When the printing starts, the detection section 60 starts detection of the presence or absence of contact with the paper roll 5, in accordance with the control threshold values (D1, D2, D3, and N1) that are indicated in the control table that has been extracted from the memory 33 (Step S6).

When the detection section 60 does not detect contact with the paper roll 5 (No in Step S6, specifically, when "$0 \leq Dx < D1$" is satisfied), the printing is continued, and when the printing that has been specified by the printing job is completed (Yes in Step S7 in which whether the printing has been completed is determined), the printing operation ends.

When the detection section 60 has detected contact with the paper roll 5 (Yes in Step S6), the degree of contact with the paper roll 5 (the output value Dx of the detection section 60) is immediately determined (Step S8).

In Step S8, when the degree of contact with the paper roll 5 is determined to be a "light friction degree contact" ($D1 \leq Dx < D2$), a path operation in the scanning movement that is being executed ends (Step S9). As a result, the carriage 41 is moved to a retraction area outside the area that faces the platen 55.

Next, the value of the counter n for the number of times in each of which contact has been determined to be a "light friction degree contact" is counted (Step S10). Here, it is assumed that the counter n is reset to "n=0" at the time of start of the printing.

Next, it is determined whether the counted value of the counter n reaches the threshold value N1 (the number of times for which each of which taking measures is determined to be needed when a "light friction degree contact" is repeated) (Step S11), and when the counted value of the counter n does not reach the threshold value N1 (No in Step S11), the printing is continued, and the flow returns to Step S6.

When the counted value of the counter n reaches the threshold value N1 (Yes in Step S11), the printing job is stopped (Step S12), and corresponding error display is performed (Step S13). The error display is performed, for example, on a display screen of the image processing apparatus 110.

The operator of the printer 100 takes appropriate measures (maintenance of the paper roll 5 or the like) in accordance with the error display (Step S14) to resume the printing (Step S15). The printer 100 resumes the printing, and the flow returns to Step S6.

That is, the control section 30 controls the movement section 20 in accordance with the number of times in each of which the output value Dx exceeds the specific threshold value D1.

In Step S8, when the degree of contact with the paper roll 5 is determined to be a "contact in which mechanical damage (damage to the carriage 41 and the ejecting head 13) is not concerned, but an impact on the printing quality is concerned" (when "$D2 \leq Dx < D3$" is satisfied), first, the path operation is stopped (that is, the ejecting operation of ink and the movement of the carriage 41 are stopped) (Step S16), and it is determined whether the movement of the carriage 41 may be resumed (Step S17). When the carriage 41 may not be moved (No in Step S17), the carriage 41 remains to be stopped, and the printing job is stopped (Step S12).

When the carriage 41 can be moved (Yes in Step S17), the carriage 41 is moved to the retraction area outside the area that faces the platen 55 (Step S18). At that time, the direction in which the carriage 41 is moved is basically a direction away from the detection section 60 that has detected the contact with the paper roll 5. In addition, retraction measurements (cleaning of the ejecting head 13, usage of a cap for preventing the ejecting head 13 from drying, and flushing, and the like as necessary) that can be executed for the ejecting head 13 on the side to where the carriage 41 has been retracted.

Here, whether the carriage 41 can be moved in Step S17 is determined when the control section 30 senses a motor load of the carriage motor.

Next, error display corresponding to the degree of contact with the paper roll 5 is performed (Step S13). The error display is performed, for example, on the display screen of the image processing apparatus 110.

The operator of the printer 100 takes appropriate measures (maintenance of the paper roll 5, cleaning of the ejecting head 13, and the like) based on the error display (Step S14) to resume the printing (Step S15). The printer 100 resumes the printing, and the flow returns to Step S6.

In Step S8, the degree of contact with the paper roll 5 is determined to be a "contact in which mechanical damage is concerned" (when "$D3 \leq Dx$" is satisfied), the path operation is immediately stopped (that is, the ejecting operation of ink and the movement of the carriage 41 are stopped) (Step S19), and the printing job is stopped as is (Step S12).

Next, the error display corresponding to the degree of contact with the paper roll 5 is performed (Step S13). The error display is performed, for example, on the display screen of the image processing apparatus 110.

The operator of the printer 100 takes appropriate measures (maintenance of the paper roll 5, cleaning of the ejecting head 13, and the like) based on the error display (Step S14) to resume the printing (Step S15). The printer 100 resumes the printing, and the flow returns to Step S6.

As described above, in Step S8, the degree of contact with the paper roll 5 is determined in accordance with the output value Dx of the detection section 60, and the control section 30 controls the movement section 20 (scanning section 40) that moves the carriage 41 and the platen 55 relative to each other, in accordance with the determination result.

Here, in the printer 100, the platen 55 is fixed, and therefore, the relative movement is controlled such that the carriage 41 is moved. Thus, when the printing apparatus is configured such that the platen as a printing medium supporting section can be moved, the control section of the printing apparatus controls and moves the platen relative to the carriage in accordance with the output value Dx of the detection section 60. That is, in the relative movement, at least movement of one of the platen and carriage is controlled.

In addition, as described above, the control section 30 determines the degree of contact with the paper roll 5 in accordance with the output value Dx of the detection section 60, and controls a series of path operations (that is, the control operation including the ink ejecting operation) and controls a printing job and the like in accordance with the determination result. That is, in the embodiment, the printing section 10 is controlled in accordance with the output value from the encoder 62 (that is, an external force that has been applied to the detector plate 61 by contact with the paper roll 5), in addition to control of the movement section 20.

As described above, in the printing apparatus according to the embodiment, the following effects can be obtained. The printing apparatus includes the detector plate 61 displaced in accordance with an external force that has been applied in response to contact with the paper roll 5 and the encoder 62 that measures a displacement amount of the detector plate 61 and outputs an output value corresponding to the displacement amount, and therefore, the degree of contact between the paper roll 5 and the detector plate 61 provided in the carriage 41 can be detected.

In addition, the movement of the carriage 41 can be controlled in accordance with the output value from the encoder 62 (that is, an external force that has been applied to the detector plate 61 by the contact with the paper roll 5). As a result, a printing sequence can be appropriately switched, for example, depending on a state of contact such as rubbing, jamming, or contact with foreign matter, and unnecessary downtime can be prevented from occurring.

In addition, the relative movement operation between the carriage 41 and the platen 55 can be controlled in accordance with the number of times in each of which the output value from the encoder 62 Dx has exceeded the specific threshold value D1. Therefore, the carriage 41 can be controlled so as to be temporarily stopped or the like, for example, even when frequency of a light contact becomes high in addition to a case in which strength of contact becomes simply high. As a result, the user (operator) of the printing apparatus is urged to perform required maintenance, and a mild impact on a printed material can be removed and occurrence of a severe impact can be prevented.

In addition, the control section 30 controls the movement section 20 in accordance with an output value corresponding to a displacement amount of the detector plate 61 displaced in accordance with an external force that has been applied in response to contact with the paper roll 5 and a type of the paper roll 5. Therefore, the printing sequence can be further appropriately controlled in accordance with the degree of influence of the contact with the paper roll 5.

In addition, the detector plate 61 is provided closer to the platen 55 compared with the ejecting head 13, and therefore, before the paper roll 5 is in contact with the ejecting head 13, contact with the paper roll 5 can be detected. As a result, damage can be prevented from being given to the ejecting head 13.

Here, the invention is not limited to the above-described embodiment, and various changes and improvements can be made for the above-described embodiment. Modifications are described below. Here, the same symbol is used for a configuration similar to that of the above-described embodiment, and a duplicate explanation is omitted herein.

First Modification

In the first embodiment, as illustrated in the flowchart of FIG. 7, for the threshold value N1 for the number of times in each of which contact with the paper roll 5 occurs, the value of the counter n for the number of times is reset to "n=0" at the time of start of the printing, and in a case in which the number of times in each of which contact with the paper roll occurs reaches the specific threshold value N1 during execution of the printing job, the printing is stopped, and error display is performed. In other words, in the first embodiment, if the counter n reaches the threshold value N1, the printing is stopped, and error display is performed. However, the invention is not limited to such control.

For example, the number of times in each of which contact with the paper roll 5 occurs during a single path operation is accumulated, and the control may be performed such that the printing may be stopped, and error display may be performed when the number of times has reached the specific threshold value N1 during the single path operation. At that time, the value of the counter n for the number of times is reset to "n=0" each time a path operation is completed.

In a case in which such control is performed, for example, the printing is continued for a "light friction degree contact" that occurs once for each path operation, and when rubbing continuously occurs in a single path operation, the printing is stopped, and the operator is caused to take measures for the rubbing.

Here, a method in which the number of times in each of which contact with the paper roll 5 occurs is counted and compared with the threshold value N1 is not limited to the method in which the value of the counter n is reset to "n=0" at the beginning of a time period that is a count target, and the counted value of the counter n is compared with the threshold value N1, and may be a method in which the value of the counter n at the beginning of the time period that is the count target is stored, and a difference between the stored value of the counter n and the counted value of the counter n is compared with the threshold value N1.

Second Modification

Figure 8:
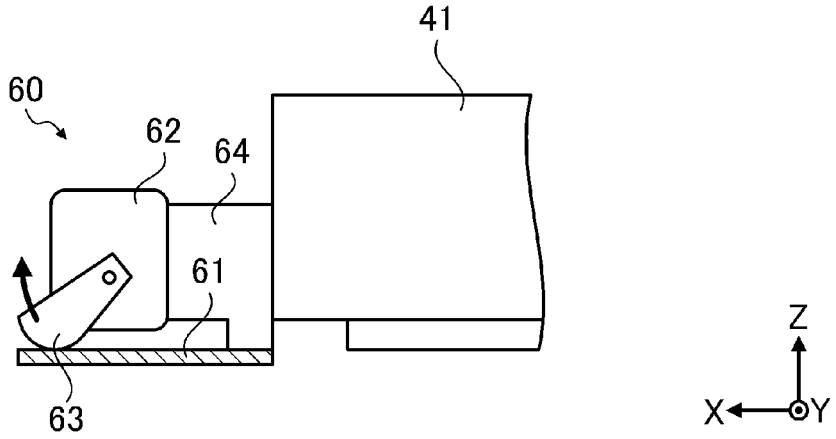
FIG. 8 is a side view illustrating a configuration of a detection section according to a second modification.

FIG. 8 is a side view illustrating a configuration of a detection section 60 according to a second modification.

In the first embodiment, as illustrated in FIG. 5, the detection section 60 is configured such that the detector plate 61 and the encoder 62 are separately installed in the carriage 41, but the configuration is not limited to such an example. For example, as illustrated in FIG. 8, the detector plate 61 and the encoder 62 may be configured as a single detection section 60 so as to be connected to each other in advance through the supporting section 64, and installed in the carriage 41.

In such a configuration, maintenance and installation of the detection section 60 are made easier.

Here, the detector plate 61 and the encoder 62 are configured as a single detection section 60 such that an inertial sensor (a gyro sensor, an acceleration sensor, or the like) is installed in an area of the free end of the detector plate 61 by using the inertial sensor as the encoder 62.

Third Modification

Figure 9:
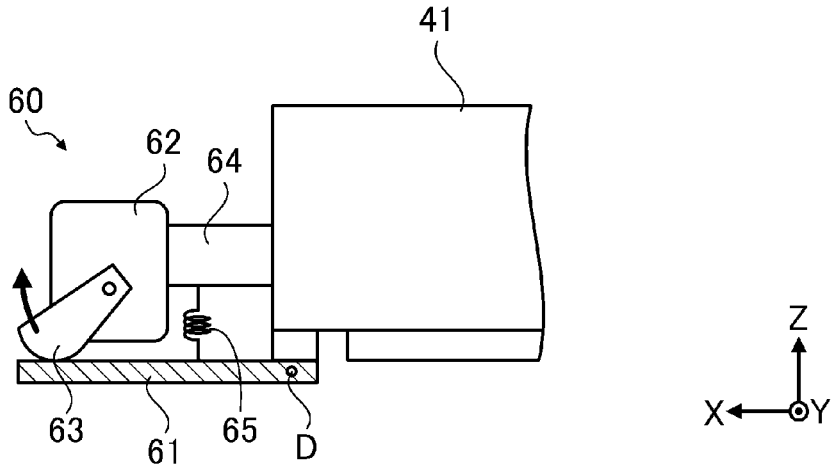
FIG. 9 is a side view illustrating a configuration of a detection section according to a third modification.

FIG. 9 is a side view illustrating a configuration of a detection section 60 according to a third modification.

In the first embodiment, as illustrated in FIG. 5, one end of the detector plate 61 of in the scanning direction (X-axis direction) is respectively fixed to the area of the lower end surface on each side of the carriage 41 in the scanning direction (X-axis direction), and the other end of the detector plates 61 is respectively provided so as to become a free end on the side opposite to the carriages 41. In addition, the detector plate 61 is an elastic material, and is displaced in accordance with an external force that has been applied in response to contact with the paper roll 5, and is returned to the original position when the external force in response to contact with the paper roll 5 is no longer applied. However, the detector plate 61 is not limited to such a configuration, and as illustrated in FIG. 9, one end of the detector plate 61 in the scanning direction (X-axis direction) is rotatably supported by the rotation axis D in the Y-axis direction at an area of the lower end surfaces on each side of the carriage 41 in the scanning direction (X-axis direction), and the detector plate 61 is connected to the area so as to be rotated around the rotation axis D. In addition, the detector plate 61 is connected to the supporting section 64 through an elastic member 65 at a part separated from the rotation axis D. The detector plate 61 is returned to the original position (that is, the position at which the detector 61 becomes almost parallel to the platen 55) by the effect of resilience of the elastic member 65 when the external force in response to contact with the paper roll 5 is no longer applied.

In such a configuration, the detector plate 61 can be made of a material having high-rigidity close to a rigid body, and occurrence of a displacement detection error due to deformation of the detection plate 61 can be suppressed.

Fourth Modification

Figure 10:
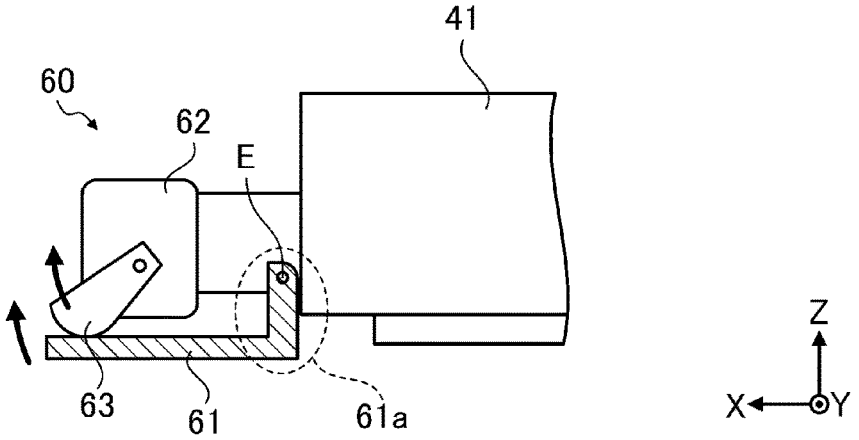
FIG. 10 is a side view illustrating a configuration of a detection section according to a fourth modification.

FIG. 10 is a side view illustrating a configuration of a detection section 60 according to a fourth modification.

In the first embodiment, as illustrated in FIG. 5, one end of the detector plate 61 in the scanning direction (X-axis direction) is respectively fixed to an area of the lower end surface on each sides of the carriage 41 in the scanning direction (X-axis direction), and the other end of the detector plate 61 becomes a free end on the side opposite to the carriage 41. In addition, the detector plate 61 is an elastic material, and is displaced in accordance with an external force that has been applied in response to contact with the paper roll 5, and returned to the original position when the external force in response to contact with the paper roll 5 is no longer applied. However, the detector plate 61 is not limited to such a configuration, and as illustrated in FIG. 10, in the detector plates 61, the upper ends of connection elements 61*a*, which extends upward from one end of the detector plate 61 in the scanning direction (X-axis direction) may be respectively rotatably supported by rotation axis E that extends in the Y-axis direction at an area of the lower end surface on each side of the carriage 41 in the scanning direction (X-axis direction) (supporting section that supports the encoders 62 in the example of FIG. 10), and the detector plate 61 may be connected to the connection element 61*a* so as to be rotated around the rotation axis E. The detector plate 61 is returned to the original position by its own weight (that is, the position at which the detector plate 61 becomes almost parallel to the platen 55) when the external force in response to contact with the paper roll 5 is no longer applied. In addition, at the original position, the side surface on the −X side of the connection element 61*a* is in contact with the side surface on the +X side of the carriage 41, such that the detector plate 61 is supported at a location in which the detector place 61 becomes almost parallel to the platen 55.

In such a configuration, the detector place 61 can be returned to the original position almost parallel to the platen 55 without an elastic force of the detector plate 61, and therefore, the detector plate 61 can be made of a material having high-rigidity close to a rigid body. As a result, for example, influence of residual vibration of the detector plate 61, which is generated by contact with the paper roll 5 (influence when contact is counted a plurality of times, or the like), can be suppressed.

Fifth Modification

Figure 11:
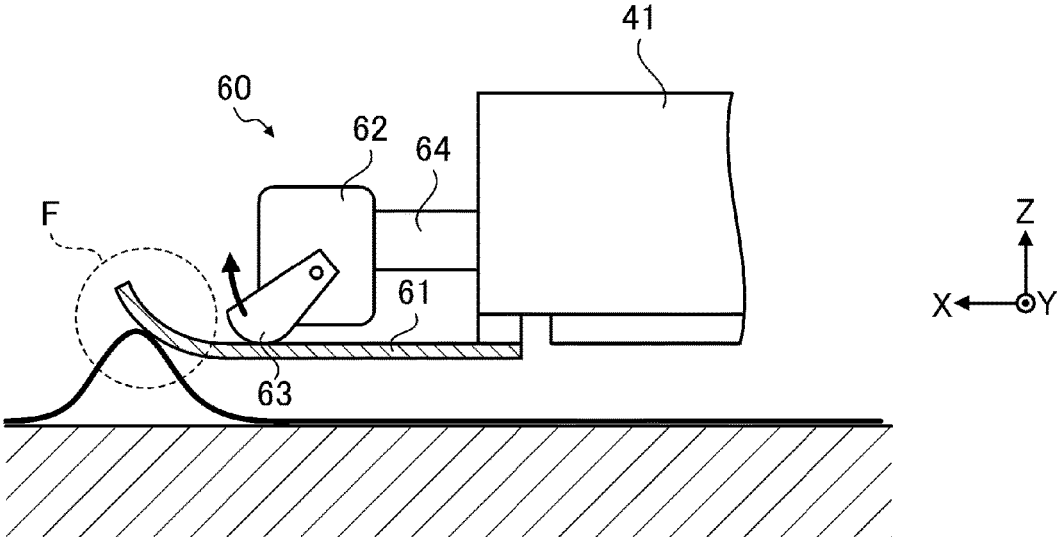
FIG. 11 is a side view illustrating a configuration of a detection section according to a fifth modification.

FIG. 11 is a side view illustrating a configuration of a detection section 60 according to a fifth modification.

In the first embodiment, as illustrated in FIG. 5, the detector plate 61 is a flat plate provided almost parallel to the platen 55, but the detector plate 61 is not limited to such an example. As illustrated in FIG. 11, an end of the detector plate 61 on the side opposite to the carriage 41, may be curved upward (in the +Z direction). Alternatively, the end of the detector plate 61 is not necessarily curved but may have a shape including a slanted surface that gradually rises upward (in the +Z direction) on the side opposite to the carriage 41.

In such a configuration, for example, even when the paper roll 5 is in contact with the detector plate 61 at a height that exceeds the height hs (see FIG. 5) from the surface of the platen 55 to the bottom surface of the detector plate 61, it can be suppressed that the paper roll 5 gets caught by the detector plate 61.

Sixth Modification

Figure 12:
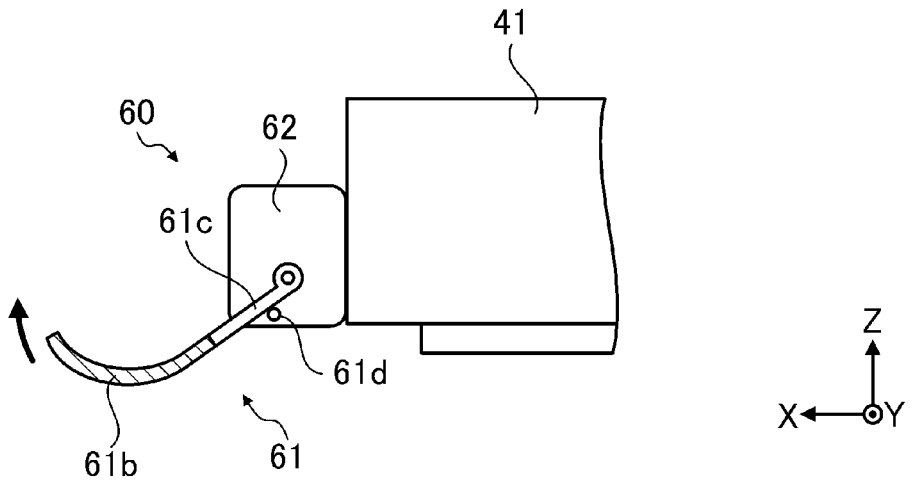
FIG. 12 is a side view illustrating a configuration of a detection section according to a sixth modification.

FIG. 12 is a side view illustrating a configuration of a detection section 60 according to a sixth modification.

In the first embodiment, as illustrated in FIG. 5, the rotation piece 63 and the detection plate 61 are separated from each other, and the rotation piece 63 is in contact with the upper surface of the free end area of the detector plate 61, but a configuration of the detection section 60 is not limited to such an example. For example, as illustrated in FIG. 12, a contact plate 61*b* of the detector plate 61, which is in contact with the paper roll 5, and a connection section 61*c* that connects the contact plate 61*b* with a rotation angle detection shaft of the encoder 62 may be integrated (or may be provided so as to be separated from each other but connected and fixed together to become a one-piece structure. Here, the contact plate 61*b* has a shape curved upward as illustrated in the detector plate 61 according to the fifth modification. In addition, the detector plate 61 is returned to the original position by its own weight when the external force in response to contact with the paper roll 5 is no longer applied. The detector plate 61 (connection section 61*c*) is in contact with a projection (stopper 61*d*) provided on the encoder 62 to be supported at the original position.

In such a configuration, the detection section 60 can be configured by using a simpler structure.

This application claims priority under 35 U.S.C. § 119 to Japanese Patent Application No. 2017-016532, filed Feb. 1, 2017. The entire disclosure of Japanese Patent Application No. 2017-016532 is hereby incorporated herein by reference.

What is claimed is:

1. A printing apparatus comprising:

an ejecting head that ejects droplets onto a surface of a printing medium;

a carriage on which the ejecting head is mounted;

a printing medium supporting section that faces the ejecting head and supports the printing medium;

a displacement section that is provided in the carriage and is displaced in accordance with an external force applied in response to contact with the printing medium;

an encoder that measures a displacement amount of the displacement section and outputs an output value corresponding to the displacement amount; and a control section that counts a number of contacts between the displacement section and the printing medium and stores the number of contacts.

2. The printing apparatus according to claim 1 further comprising:

a movement section that moves the carriage and the printing medium supporting section relative to each other wherein the control section controls the movement section in accordance with the output value.

3. The printing apparatus according to claim 2, wherein the control section controls the movement section in accordance with a number of times in each of which the output value exceeds a specific threshold value.

4. The printing apparatus according to claim 2, wherein the control section controls the movement section based on a type of the printing medium.

5. The printing apparatus according to claim 1, wherein the displacement section is provided close to the printing medium supporting section compared with the ejecting head.

* * * * *